United States Patent [19]

Hoskins et al.

[11] Patent Number: 4,924,732

[45] Date of Patent: May 15, 1990

[54] POWER DRIVEN SCREWDRIVER WITH VACUUM FOR REMOVING CONTAMINANTS

[75] Inventors: Robert G. Hoskins, Batavia; Alan R. Krokenberger, Rochester, both of N.Y.

[73] Assignee: Alliance Automation Systems, Inc., Rochester, N.Y.

[21] Appl. No.: 310,494

[22] Filed: Feb. 13, 1989

Related U.S. Application Data

[63] Continuation of Ser. No. 78,133, Jul. 27, 1987, abandoned.

[51] Int. Cl.[5] ..... B25B 23/08; B25B 21/00

[52] U.S. Cl. ..... 81/54; 81/451

[58] Field of Search ..... 81/57.37, 451, 430–435, 81/54; 29/718

[56] References Cited

FOREIGN PATENT DOCUMENTS

| | | | |
|---|---|---|---|
| 1277768 | 9/1968 | Fed. Rep. of Germany | 81/451 |
| 26479 | 7/1971 | Japan | 81/57.37 |
| 2068284 | 8/1981 | United Kingdom | 81/451 |

*Primary Examiner*—D. S. Meislin

*Attorney, Agent, or Firm*—John R. Benefiel; Raymond J. Eifler

[57] ABSTRACT

A screwdriver includes a power driven spindle (50) having an end face (52), an enclosure defining a closed cavity (70, 24, 14), a sleeve (60) having a central bore (70) communicating with said cavity and having a forward opening (70c) to receive the head (94) and part of the thread of a threaded fastener (90), and a vacuum (86, 88) for lowering the pressure in the cavity and continuously drawing air from the forward end of the sleeve past the head while holding the head while the fastener is held in a forward end portion (60a) of the sleeve and without driving the spindle. The spindle drives the fastener forwardly and into a workpiece (96) and an air path (70d, 70c, 70b, 70a) sucks contaminants rearwardly and from the workplace.

10 Claims, 2 Drawing Sheets

POWER DRIVEN SCREWDRIVER WITH VACUUM FOR REMOVING CONTAMINANTS

This application is a continuation of application Ser. No. 07/078,133, filed 07-27-87, now abandoned.

This invention relates to a power driven tool such as a screwdriver and more particularly to a screwdriver having motor means and a spindle disposed in a common cavity evacuated by a vacuum whereby to remove contaminants from the workplace.

In clean rooms contaminants and other particulates oftentimes cannot exceed 100 particles per cubic foot with the particulate being no greater than ½ micron. While dust covers and the like are known, isolation of contaminants resulting from powered machinery presents special problems. Ideally, the machinery should leave the clean room as clean as it was or cleaner.

In "Machine for Automatically Driving Threaded Fasteners" U.S. Pat. No. 3,583,451, issuing June 8, 1971 to Dixon, a vacuum is established in a rubber sleeve at the end of a centrally bored spindle driven by a motor and telescoped over a screwdriver whereby to hold the head of a threaded screw received therein for rotational driving engagement by the screwdriver and axial advance with the spindle whereby to drive the screw into a workpiece. The motor is separate from the spindle and could be source of particulates. The spindle is partially centrally bored whereby to pull a vacuum on the screw head but has no provision for contaminant removal adjacent the workpiece because the sleeve seals about the screw head. Other moving parts such as cam operated jaws are disposed above the workpiece and particulates such as oil or metal flakes are not prevented from contaminating the workpiece. Desirably the working end of the tool would assist in contaminant prevention and removal.

In a machine for driving a threaded fastener, there is a housing including an interior chamber, a motor supported in the chamber, a sleeve having an axial bore extending between forward and rearward ends thereof with the forward end being open and sized to telescope over the fastener, a spindle mounted for reciprocation and rotation and including a rearward end drivingly connected to the motor and a forward end configured to engage the fastener, and pressure differential means operable to create a vacuum sufficient to hold the fastener in the forward end of the sleeve.

In accord with this invention, the forward end portion of the sleeve telescopes over the head and a thread portion of the fastener such that the forward end of the spindle engages the head. An enclosure including the housing defines a closed cavity around both the motor and the spindle, the cavity including the axial bore of the sleeve whereby to communicate air from the open forward end rearwardly.

An arrangement is provided for lowering the pressure in the bore and for drawing air from the forward opening of the sleeve and rearwardly past the head of a fastener while the fastener is in the forward end portion of the sleeve. The forward end face of the sleeve is provided with radial grooves to communicate air exterior of the sleeve into the bore, the forward end face engaging but not sealing about the workpiece. When the fastener head engages the spindle an annulus separates the outer periphery of the head and the inner wall of the sleeve. An air path is defined between the outer periphery of the spindle and the inner wall of the sleeve to allow air to pass rearwardly of the head and about the spindle. Any contamination adjacent the open end and or from the motor is thereby evacuated rearwardly of the fastener by the pressure differential air flow.

The screwdriver includes signal means simultaneously comparing torque output of the motor and axial advance of the spindle for transmitting a signal that the fastener has been properly advanced and provided with a desired torque.

Such a screwdriver advantageously provides a self-cleaning machine which leaves the work area cleaner than when it started without sacrificing user desired information regarding the state of the threaded insertion.

The foregoing and other advantages will become more apparent when viewed in light of the accompanying drawings and following detailed description wherein.

Figure 1:
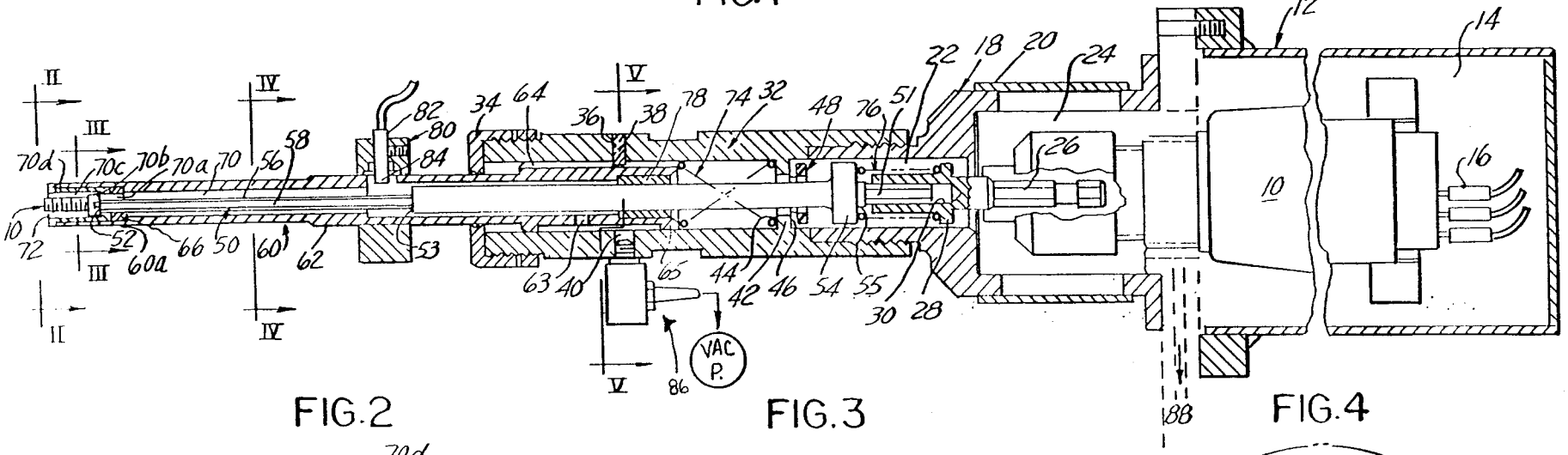
FIG. 1 is an elevation view in section of screwdriver in accord with this invention.

Turning now to the drawings, FIG. 1 shows a power driven screwdriver including a driver 10, a driver cover 12, a clutch housing 18 including a clutch adjustment cover 20, a hex driver 26, a mandrel housing 32, a sleeve 60 having a flat forward end face 72 and a central bore 70, a proximity switch mounting block 80, and a spindle 50 each being generally coaxially disposed along a primary axis through the screwdriver. A threaded fastener 90 is shown with its head 94 disposed in the sleeve and abutted against the forward end 52 of the spindle whereby to be power driven into a workplace. (See FIGS. 6–8).

The driver cover 12, clutch adjustment sleeve 20, clutch housing 18 and sleeve 60 cooperate to define a shaped casing describing an interior cavity that completely encloses the spindle 50, the driver 10 and the driving interconnection therebetween. A vacuum pump (not shown) is connected to the mandrel housing 32 at 86 and to the driver cover at 88. The vacuum lowers the pressure in the bore and draws air from the forward opening of the sleeve rearwardly past the head 94 while the head is held in the forward end of the sleeve whereby to evacuate contamination from the workplace and the motor through the screwdriver. Contaminants from either the driver or adjacent the end face 72 of the sleeve are evacuated from the workspace by the vacuum pump.

The driver 10 is mountably positioned in a chamber 14 formed by the driver cover 12 and has a forward end portion inclding a central hexagonal shaped bore extending inwardly from its forward end to engagingly receive the hex driver whereby to engage and rotatably drive the spindle 50. The driver is a motor commercially available from many sources and will not be described further. A torque sensor 16 is connected to the motor to send a signal indicating that a proper torque has been placed on the threaded fastener.

The clutch housing 18 is positioned such that its rearward end is secured to the driver cover 12 and its forward end is connected to the mandrel housing 32. A stepped bore extends between the ends of the clutch housing and includes an enlarged rearward bore portion 24 positioned to receive and circumpose the rearward end of the hex driver and a reduced forward bore portion 22 to receive and circumpose the forward end of the hex driver and the rearward end portion of the spindle. The hex driver 26 includes a medial radial flange 28, a rearward end portion inserted into the shaped bore of the driver 10, and a forward end portion including a central hexagonal shaped bore 30 extending inwardly from its forward end to engagingly receive the spindle.

The mandrel housing 32 is fixedly secured at its rearward end to the clutch housing 18 and includes a threaded outer periphery at its forward end adapted to threadably engage a retention cap 34 mounted thereabout. Intermediate its opposite ends is a first and a second radial bore 36, 40 the second bore 40 defining an opening connectable through 86 with a vacuum pump and the first bore 36 receiving a guide lug 38 the inward end of which being adapted to seat within a longitudinal groove 64 extending along a rearward end portion of the sleeve 60. An inward radial flange 42 defines a forward facing annular shoulder 44 and a rearward facing annular shoulder 46, the forward facing annular shoulder 44 is for supporting one end of a coil spring 74 and the rearward facing annular shoulder 46 is for engaging a washer 48.

The washer 48 is flat, annular and provided with a central opening to pass the rearward end of the spindle, the washer being inserted therein to provide an axial bearing surface in a "floating" fashion for the spindle during its forward stroke to rotatingly bear against. Preferably the washer is comprised of teflon to reduce wear and friction.

The spindle 50 is solid, generally cylindrical and includes the forward end 52 being configured to drive the threaded fastener, a rearward end 51 being adapted to be driven and defined by a hexagonal extension adapted to slidably reciprocate within the bore 30 of the hex driver, a medial annular shoulder 54 extending radially outward and having a rearward facing annular shoulder 55, and a stepped shoulder 53. Shown best in FIG. 3, the forward end portion of the spindle has three flats 56 and three arcuate portions 58 each equiangularly spaced and extending longitudinally rearward from forward end 52 to the shoulder 53.

A coil spring 76 has its forward end engaging the rearward facing annular shoulder 55 and its rearward end engaging the radial flange 28 on the hex driver 26 whereby to bias the spindle axially forwardly during forward movement of the screwdriver during threaded advancement of the fastener.

The sleeve 60 is mounted for reciprocation relative to the mandrel housing and has a forward end portion **60*a* extending outwardly of the mandrel housing, a rearward end 65 disposed interiorly of the mandrel housing, a generally cylindrical center bore 70, a generally cylindrical outer periphery 62 and a cylindrical bushing 66 having a forward end face 68 and interference fit in the forward end portion of the bore 70. The bushing has a stepped bore including a forward open end portion 70*c* defining an opening or enclosure sized to telescope about the head 94 of the fastener 90 and part of the threaded body 92 and a rearward portion 70*a*. The forward end faces 72,68 of the sleeve 60 and the bushing 66 are flat and substantially coplanar and each includes radial grooves 70*d* on their respective end faces, the grooves extending into the opening 70*c*. The rearward end portion of the sleeve includes longitudinally extending grooves 64 on its outer periphery one groove being adapted to receive the lug 38 for axially guiding the sleeve. Coil spring 74 has one end thereof engaged against the rearward end of the sleeve 60 and the other end engaged against the forward facing annular shoulder 44** in the mandrel housing whereby to bias the spindle axially forward.

A bearing member 78 is disposed about the spindle adjacent the rearward end portion of the sleeve. An inward radial bore or opening 63 is disposed adjacent the vacuum opening at 86 in the mandrel for evacuating the central bore extending through the sleeve.

A proximity sensor 82 is disposed in the mounting block 80 with a probe 84 from the sensor being disposed forwardly of the stepped shoulder 53 on the spindle 50 for detecting the advance of the spindle thereby providing an indication of axial advance of the threaded fastener into its threaded socket. The torque sensor 16 and proximity sensor 82 work simultaneously to indicate the status of the fastener. If the spindle advance is less than a predetermined amount but the motor torque is adequate, this condition could be indicative that the fastener may have cross-threaded in its socket. Conversely if the spindle advance appears to be as desired and indicative of proper fastener advance but the torque reading is not adequate this could be indicative that the threads in the socket are stripped.

Figure 2:
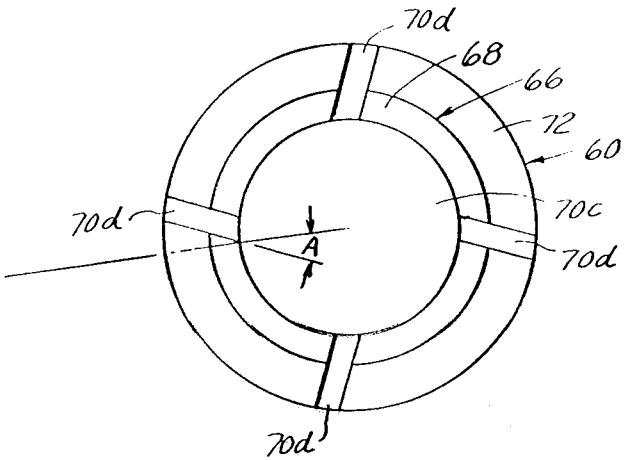
FIG. 2 is a front end view.
Figure 7:
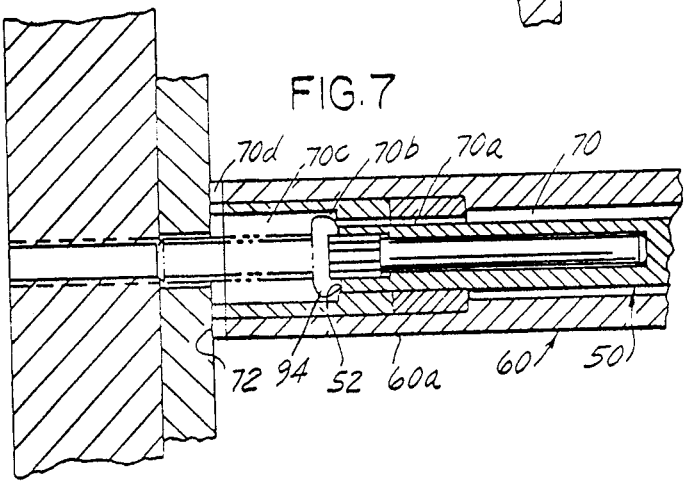

FIG. 2 shows the forward end faces 68 and 72 of the bushing 66 and sleeve 60 when the bushing is coaxially disposed in a forward end portion 60a of the sleeve 60, the end faces being substantially flat to non-sealingly seat against the surface 97 of workpiece 96 (see FIG. 7). Extending between the outer periphery 62 of the sleeve and the inner wall of the bushing 66 into center bore **70*c* are the four radial grooves 70d each being disposed at an acute angle "A" relative to a radius drawn outwardly from the sleeve axis. These radial grooves are provided to communicate air externally of the sleeve through the opening 70*c* in the open forward end, through the portion 70*a* and rearwardly into the central bore 70** whereby to suck contaminants either from the fastener itself, from the threading action, or from the workpiece itself through the screwdriver. The grooves preferably are at the acute angle "A" to a radius through the sleeve center axis to cause a turbulent swirling effect interiorly of the bore. The turbulence caused by the pressure differential and air flow is important to lift particles which might otherwise be unaffected by a vacuum alone.

Figure 3:
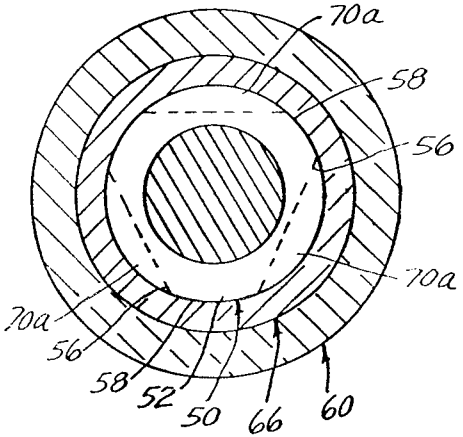
FIG. 3 is a section view taken along lines III—III of FIG. 1.

FIG. 3 shows the interior of the sleeve 60 at the location **60*a* rearwardly of the forward end face 72. The cross-section of the spindle forward end portion is uniform and includes three arcuate portions 58 which are generally clearance fit for reciprocation within the bore 70*a* of bushing 66 and three flats 56, each flat being in a plane generally parallel to the sleeve axis, equiangularly disposed and extending longitudinally rearward from the forward end 52. The radial separation between the inner wall defining the inner bore of the bushing and the flats 56 defines the air passage 70*a*. When mounted in the opening 70*c*, the fastener head 94** substantially fills an annular space 70*b* adjacent the spindle end face 52 and partially blocks access to the passage 70*a*. However, prior to rotation of the spindle and/or the fastener, air continually flows to draw particles inwardly and rearwardly through the air path 70*d*, 70*c*, 70*b*, 70*a* and 70 and the air pressure acts to hold the head against the spindle.

Figure 4:
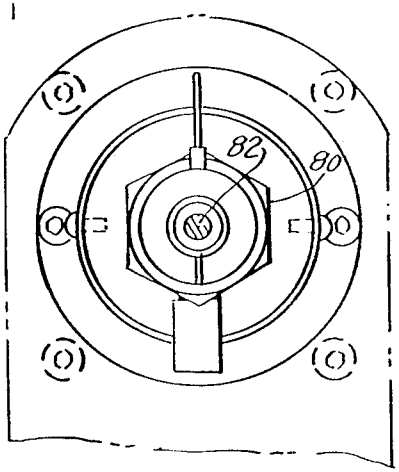
FIG. 4 is a section view taken along lines IV—IV of FIG. 1.

FIG. 4 shows the proximity sensor 82 and the mounting block 80. The sensor probe 84 is inside the bore and adapted to sense the presence of the stepped shoulder 53 of the spindle during its downward stroke such presence indicating that the threaded fastener has been fully threaded to the desired depth.

Figure 5:
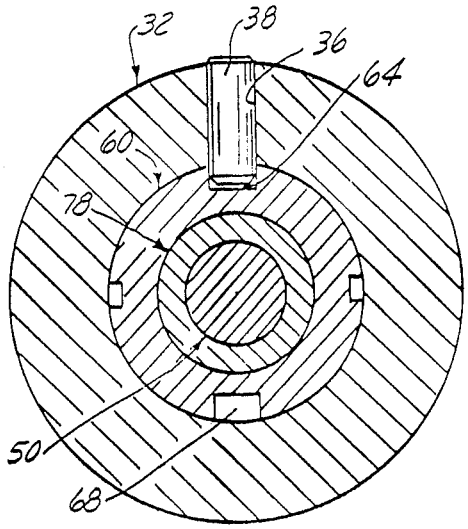
FIG. 5 is a section view taken along lines V—V of FIG. 1.
Figure 5:
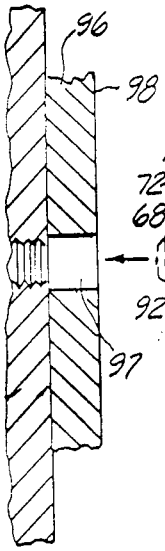

FIG. 5 shows the mandrel housing 32, the sleeve 60, and the bearing 78 each disposed concentrically around the spindle 50. The lug 38 extends radially inwardly from the mandrel housing such that its free end is in the axially rearwardly extending groove 64 in the sleeve 60.

Figure 6:
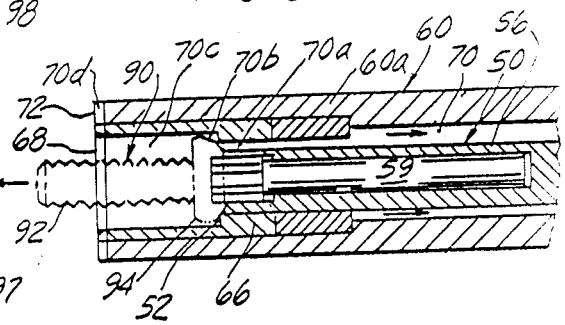
FIGS. 6, 7 and 8 are section views of the front end portion of the drill showing a threaded fastener being installed on a workplace.
Figure 8:
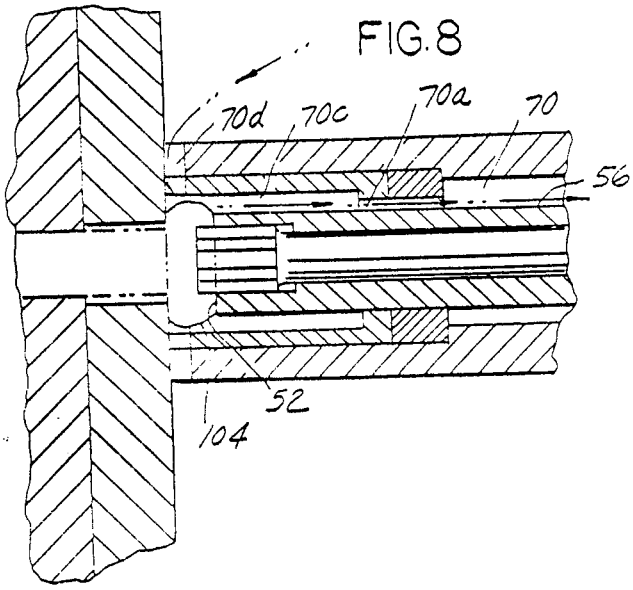

FIGS. 6, 7 and 8 show the installation of the threaded fastener 90 into a threaded socket 98 of the workpiece 96, the fastener being shown in phantom as a cap screw having a threaded body 92 and a hexagonal center recess in its cap 94. In FIG. 6 the fastener is received interiorly of the bushing 66 in the sleeve 60 such that its head 94 is disposed in opening 70*c*, seated against the end 52 of the spindle 50 and has its outer periphery at 70*b* partially blocking passage into 70*a*. A vacuum drawn at 86 lowers the pressure through the center bore 70 of the sleeve and through the path defined by 70*a*, 70*b*, 70*c*, 70*d* to impose a suction force of sufficient magnitude to hold the head 94 against the spindle end face. However, air is still drawn rearwardly past the head 94 into bore 70. Interiorly of the spindle 50 is an adapter 59 for drivingly engaging the fastener head. The adapter 59 is liquid soldered into the sleeve for securement thereto and removed therefrom by application of a heat source locally of the end.

In FIG. 7 the forward end face 72 of the sleeve 60 has been advanced and non-sealingly abutted against the top surface 97 of workpiece 96. Some air flow is entrained through the radial grooves 70*d* since the head 94 does not totally block the air path through 70*a*.

In FIG. 8 the forward end 52 of spindle 50 has axially advanced and been rotated by the motor 10 whereby to advance the fastener 90 into the socket 97. Slight forward movement of the spindle moves the fastener head 94 to completely open the passages 70*a* and access to the center bore 70 whereby the vacuum at 86 will suck air inwardly and upwardly through the foward end of the sleeve. Atmospheric pressure forces air which carries loose dirt and dust into the sleeve. The dirt laden air then passes through the bore and into a remote (not shown) collecting bag remote from the workpiece.

Figure 9:
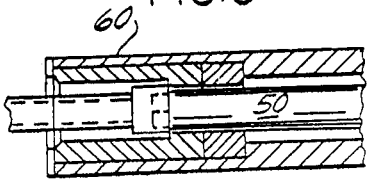
FIGS. 9, 10 and 11 are section views of alternate mounting arrangements for different headed fasteners.
Figure 10:
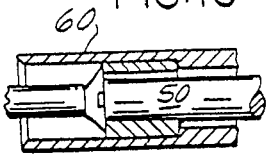
Figure 11:
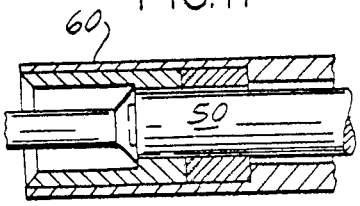

FIGS. 9, 10 and 11 show alternate arrangements for mounting different adapters into the sleeve, including a flat head and countersunk.

While the vacuum serves both to hold the fastener as well as remove contaminants from the workplace, it is to be understood that the holding of the fastener could be otherwise, such as the spindle being comprised of a magnetic material.

We claim:

1. In a device for driving an elongated headed screw fastener (90) into a threaded bore (97) of a workpiece (96) of the type including housing means (12,18,20,32), an elongated spindle (50), having a portion within said housing means, and a rotary drive motor (10) mounted in said housing means (12,18,20,32), said rotary drive motor (10) drivingly connected to said spindle (50) to enable rotation of said spindle (50) about its longitudinal axis, said spindle (50) having a forward end (52) extending out of said housing and away from said drive motor (10) configured to engage the head (94) of said fastener (90), a sleeve (60) having a forward end and a forward end face (72), said sleeve (60) provided with a bore (70*a,c*) surrounding said forward end (52) of said spindle (50) with a rearward portion (70*a*) of said bore defining a clearance space between said sleeve (60) and said spindle (50) to the rear of said forward end face (72) of said sleeve (60), bias means (74) mounting a rear portion of said sleeve (60) in said housing means so as to allow relative axial movement therebetween, said bias means (74) urging said forward end of said sleeve (60) in a direction away from said housing means, a source of vacuum, means (86,88) for connecting said source of vacuum to said clearance space to cause an air flow to be drawn into said forward end (72) of said sleeve (60) and through said clearance space to enable suction of the head (94) of said fastener (90) against said forward end (52) of said spindle (50) when said vacuum is activated and to enable rotation of said fastener (90) by rotation of said spindle (50) by said drive motor, a forward portion (70*c*) of said bore (70*a,c*) spaced forwardly of said rearward portion (70*a*) to be adapted to enclose the shank of said fastener (90) when said head (94) thereof is drawn against said forward end (52) of said spindle (50), said device including means (51) carried within said housing means (12,18,20,32,) for mounting said spindle (50) for axial movement relative said housing means and said sleeve (60) allowing said forward end (52) of said spindle (50) to move between a retracted position within said forward portion (70*c*) of said bore remote from the forward end face (72) of said sleeve (60) and an advanced position therein adjacent said forward end face (72) of said sleeve (60) as said fastener is advanced into said workpiece; bias means (76) urging said spindle (50) towards said advanced position; said forward portion (70*c*) of said bore receiving said air flow passing into said sleeve clearance space; whereby said fastener (90) is driven into said workpiece (96) while air is drawn along the length of said fastener (90) within said forward portion (70*c*) of said bore, past the head (94) of said fastener (90) and into said sleeve clearance space and collected by said means (86,88) connecting said clearance space with said vacuum source.

2. The device according to claim 1 wherein said rearward portion (70*a*) of said bore is of smaller diameter than said forward bore portion (70*c*) to form a shoulder therebetween, whereby a head (94) of a threaded fastener (90) of larger diameter than said rearward bore portion (70*a*) may be drawn against said shoulder by said air flow through said forward bore portion (70*c*) and said rearward bore portion (70*a*) with said spindle (50) in said retracted position to substantially block air flow from said forward bore portion (70*c*) into said rearward bore portion (70*a*), said head (94) movable off said shoulder upon axial advance of said spindle (50) from said retracted position.

3. The device according to claim 2 wherein a portion of said spindle (50) is rotatably mounted within said rearward bore portion (70*a*), and is formed with relief features (56) enabling air flow past said spindle (50) and through said rearward bore portion (70*a*) with said spindle (50) advanced from said retracted position.

4. The device according to claim 2 further including a bushing (66) received in said sleeve (60) at the forward end (72), and in which said bore portions (70*a,c*) is formed.

5. The device according to claim 1 wherein said sleeve (60) is formed with relief slots recessed into said forward end face (72) enabling air flow across the surface of said workpiece (96) and into said forward portion (70*c*) of said bore with the forward end face (72) of said sleeve (60) against a surface of a workpiece (96).

6. A method of removing air borne contaminants adjacent exposed portions of a threaded member (90) protruding out of a bore extending into a surface (98) of a workpiece (96) as said member (90) is rotated by engagement with a forward end (52) of a rotated spindle (50) and advanced into said workpiece (96), during advancing travel of said forward end (52) of said spindle (50), comprising the steps of:

substantially surrounding the exposed portions of said threaded member (90) extending out of said workpiece (96), and said forward end (52) of said spindle (50) extends within a bore (70*a,c*) provided in a sleeve (60), positioning said sleeve (60) in non sealing engagement against the surface (98) of said workpiece out of which said threaded member (90) protrudes, said bore having a portion (70*c*) being located and sized to receive and substantially surrounds said exposed portions of said threaded member with a space therebetween;

advancing said spindle (50) within said sleeve (60) while maintaining said exposed portions of said threaded member (90) substantially surrounded by said sleeve;

inducing an air flow into said sleeve through said non sealing engagement with said working surface and through said space and collecting said air flow and entrained contaminants, while said threaded member (90) is rotated and advanced into said workpiece while said exposed portions remain substantially surrounded by said sleeve (60).

7. The method according to claim 6 further including the step of positioning a head (94) on said threaded fastener (90) against a shoulder in said bore (70*a,c*) sized to abut against one end (94) of said threaded member (90) when said threaded member is drawn into said bore (70*a,c*)by air flow therethrough.

8. The method according to claim 7 further including the step of advancing said threaded member (90) off said shoulder at the initiation of rotational advancement of said threaded member (90) into said workpiece (96).

9. The method according to claim 6 further including the step of urging said spindle to be displaced axially so that said spindle (50) is advanced axially with respect to said sleeve as rotation of said threaded member (90) causes said threaded member to be axially advanced into said workpiece.

10. The method according to claim 9 further including the step of urging said sleeve (60) against the surface of said workpiece as said spindle (50) is rotated and advanced within said sleeve.

* * * * *